US008113370B2

(12) United States Patent
Zhang et al.

(10) Patent No.: US 8,113,370 B2
(45) Date of Patent: Feb. 14, 2012

(54) PLASTIC CONTAINER HAVING VACUUM PANELS

(75) Inventors: Liye Zhang, Ann Arbor, MI (US); Anna Wilcox, New York, NY (US); Rohit V. Joshi, Ann Arbor, MI (US); Juan Sancho, Ann Arbor, MI (US); Richard J. Steih, Jackson, MI (US)

(73) Assignee: Amcor Limited, Abbotsford, Victoria (AU)

( * ) Notice: Subject to any disclaimer, the term of this patent is extended or adjusted under 35 U.S.C. 154(b) by 293 days.

(21) Appl. No.: 12/215,205

(22) Filed: Jun. 25, 2008

(65) Prior Publication Data

US 2009/0321384 A1 Dec. 31, 2009

(51) Int. Cl.

| | |
|---|---|
| ***B65D 6/00*** | (2006.01) |
| ***B65D 8/04*** | (2006.01) |
| ***B65D 8/18*** | (2006.01) |

(52) U.S. Cl. ..... 215/383; 215/381; 215/382; 215/384; 220/669; 220/675

(58) Field of Classification Search ..... 220/669, 220/675; 215/381–384
See application file for complete search history.

(56) References Cited

U.S. PATENT DOCUMENTS

| | | | | |
|---|---|---|---|---|
| 5,971,184 | A * | 10/1999 | Krishnakumar et al. | 215/384 |
| 6,932,230 | B2 * | 8/2005 | Pedmo et al. | 215/381 |
| 7,191,910 | B2 * | 3/2007 | Deemer et al. | 215/381 |
| D548,088 | S * | 8/2007 | Ungrady | D9/516 |
| 2006/0289378 | A1 * | 12/2006 | Zhang | 215/381 |
| 2010/0032405 | A1 * | 2/2010 | Ozawa et al. | 215/383 |

FOREIGN PATENT DOCUMENTS

| | | |
|---|---|---|
| JP | 06-059207 | 8/1994 |
| JP | 2002-053118 | 2/2002 |
| JP | 2004-519394 | 7/2004 |
| JP | 2004-535339 | 11/2004 |
| WO | WO 95/06593 | 3/1995 |
| WO | WO 01/89934 | 5/2002 |
| WO | WO 02/074635 | 9/2002 |
| WO | WO 03/008278 | 1/2003 |

* cited by examiner

*Primary Examiner* — Anthony Stashick
*Assistant Examiner* — Madison L Wright
(74) *Attorney, Agent, or Firm* — Harness, Dickey & Pierce, P.L.C.

(57) ABSTRACT

A container structure for a hot fill liquid may employ an upper portion defining a mouth, a shoulder portion integrally formed with and extending downward from the upper portion, a bottom portion defining a base, and a body and sidewall extending between and joining the shoulder and bottom portions. The sidewall may employ a pair of opposing columns oriented diagonally relative to the base and concave inward relative to a container central vertical axis before the container is filled. The columns become concave inward to a lesser extent when the bottle is under an interior vacuum. The sidewall may also employ a pair of opposing, compound angle vacuum panels oriented diagonally relative to the base. A vacuum initiator groove is formed in each of the vacuum panels to initiate panel movement during liquid content cooling. The vacuum initiator groove is generally coincident with a vacuum panel longitudinal centerline.

22 Claims, 4 Drawing Sheets

PLASTIC CONTAINER HAVING VACUUM PANELS

FIELD

The present disclosure relates to vacuum side panels that control container deformation during reductions in product volume that occur during cooling of a hot-filled product.

BACKGROUND

The statements in this section merely provide background information related to the present disclosure and may not constitute prior art. Plastic containers, such as polyethylene terephthalate ("PET"), have become commonplace for the packaging of liquid products, such as fruit juices and sports drinks, which must be filled into a container while the liquid is hot to provide for adequate and proper sterilization. Because these plastic containers are normally filled with a hot liquid, the product that occupies the container is commonly referred to as a "hot-fill product," and the container is commonly referred to as a "hot-fill container." During filling of the container, the product is typically dispensed into the container at a temperature of at least 180° F. Immediately after filling, the container is sealed or capped, such as with a threaded cap, and as the product cools to room temperature, a negative internal pressure or vacuum forms within the sealed container. Although PET containers that are hot-filled have been in use for quite some time, such containers are not without their share of limitations.

One limitation of PET containers that receive a hot-filled product is that during cooling of the liquid product, the containers may undergo an amount of physical distortion. More specifically, a vacuum or negative internal pressure caused by a cooling and contracting internal liquid may cause the container body or sidewalls to deform in unacceptable ways to account for the pressure differential between the space inside of the container and the space outside, or atmosphere surrounding, the container. Containers with deformations are aesthetically unpleasing and may lack mechanical properties to ensure sustained container strength or sustained structural integrity while under a negative pressure.

Another limitation of PET containers that receive a hot-filled product is that they are not easily held by a hand of a handler, such as a consumer who is drinking the product directly from the container. For instance, intended container gripping areas typically located on the body of containers are not designed to conform to a user's hand while also accounting for the above-mentioned pressure differential resulting from hot-filled containers.

Another limitation of plastic containers, such as hot-fill containers, is that such containers may be susceptible to buckling during storage or transit. Typically, to facilitate storage and shipping of PET containers, they are packed in a case arrangement and then the cases are stacked case upon case on pallets. While stacked, each container is subject to buckling and compression upon itself due to direct vertical loading. Such loading may result in container deformation or container rupture, both of which are potentially permanent, which may then render the container and internal product as unsellable or unusable.

Yet another limitation with hot-filled containers lies in preserving the body strength of the container during the cooling process. One way to achieve container body strength is to place a multitude of vertical or horizontal ribs in the container to increase the moment of inertia in the body wall in select places. However, such multitude of ribs increases the amount of plastic material that must be used and thus contributes to the overall weight and size of the container.

SUMMARY

The present invention provides a hot-fillable, blow-molded plastic container suitable for receiving a liquid product that is initially delivered into the container at an elevated temperature. The container is subsequently sealed such that liquid product cooling results in a reduced product volume and a reduced pressure within the container. The container is lightweight compared to containers of similar size yet controllably accommodates the vacuum pressure created in the container. Moreover, the container provides excellent structural integrity and resistance to top loading from weight placed on top of the container.

Possessing a central vertical and a central horizontal axis, as well as a body or sidewall central horizontal axis, the container structure further employs an upper portion defining a mouth, a shoulder portion that is formed with and molded into the upper portion and that extends downward from the upper portion, a bottom portion forming a base, and a body or sidewall that extends between and joins the shoulder portion and the bottom portion. The sidewall further defines a pair of opposing columns that are oriented diagonally relative to the base and that are concave inward toward the container central vertical axis when the container is not sealed or filled with a liquid. When filled with a hot liquid that is then cooled, the opposing columns become concave inward to a lesser extent because the container interior undergoes and sustains an interior vacuum. Moreover, the body or sidewall defines a pair of opposing vacuum panels that are oriented diagonally relative to the base and that are formed with compound angles to conform to a palm of a human hand. A vacuum initiator, also called a hinge or groove, is coincident with a vacuum panel longitudinal centerline and is formed as part of each of the pair of opposing vacuum panels.

The vacuum initiator or groove may further define vacuum initiator walls such that upon contraction of the container liquid content, the groove walls initiate movement toward the container central vertical axis. The walls of the vacuum panels are parallel to each other at approximately a horizontal centerline of the sidewall or vacuum panel structure when viewed as a container cross section.

The bottom portion may have a circumferential base recession or groove, which may be horizontal and define base groove walls. The base groove may be formed outside of the vacuum panel area and at a sufficient depth to permit vertical movement of the shoulder groove walls, and thus, the container. Similarly, the shoulder of the container may define a circumferential shoulder groove defining shoulder groove walls. The shoulder groove may be horizontal and at a sufficient depth to permit vertical movement of the shoulder groove walls, and thus, the container.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
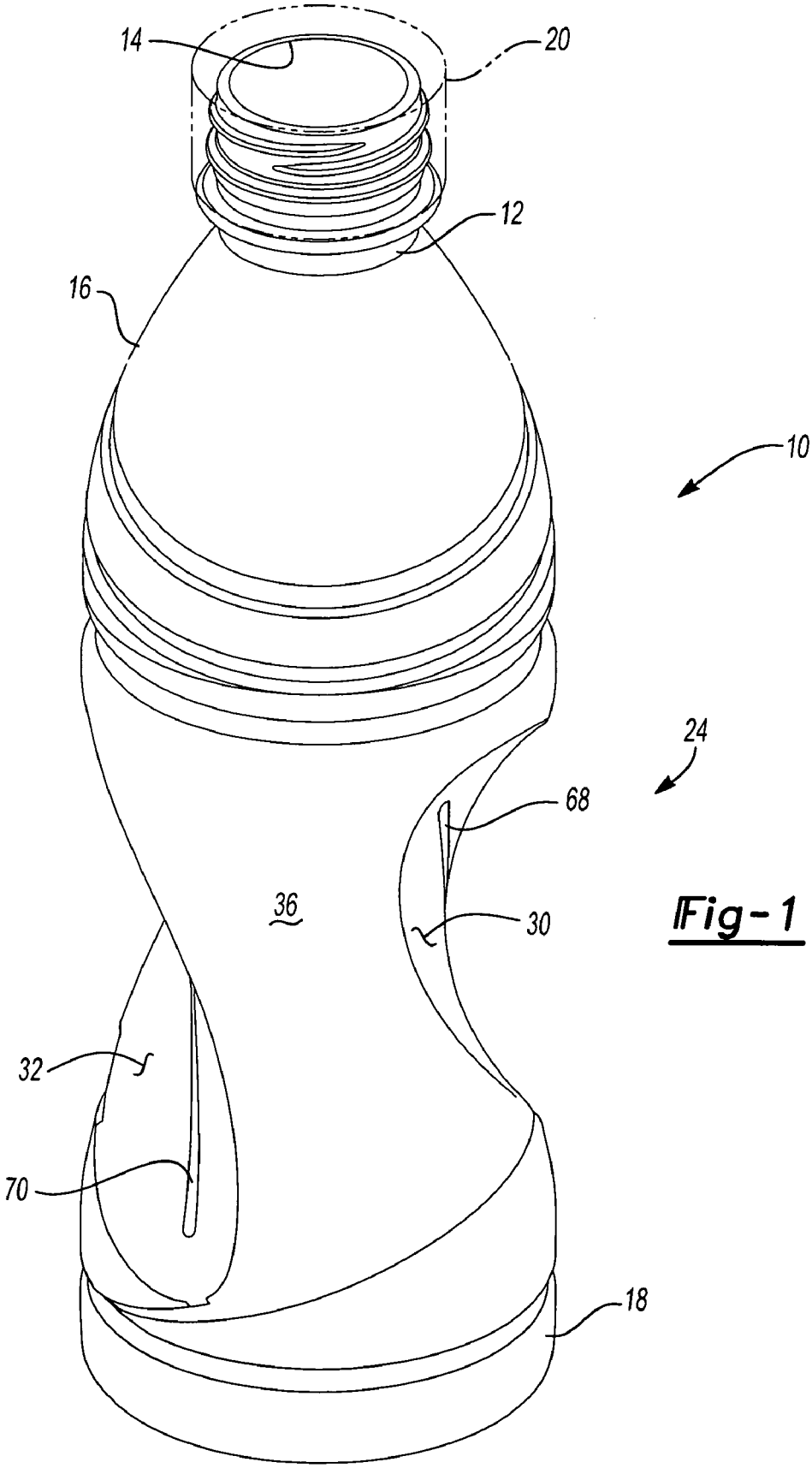
FIG. 1 is a perspective view of a container depicting a sidewall with vacuum panels and columns.

The following description is merely exemplary in nature and is not intended to limit the present disclosure, application, or uses. It should be understood that throughout the drawings, corresponding reference numerals indicate like or corresponding parts and features.

Referring now to FIGS. 1-4, and first to FIG. 1, a hot-fill, blow molded plastic container 10 is depicted that exemplifies principles of the present invention. The container 10 is designed to be filled with a product, typically a liquid 11 such as a fruit juice or sports drink, while the product is in a hot state, such as at or above 180 degrees Fahrenheit. After filling, the container 10 is sealed, such as with a cap 20 and cooled. During cooling, the volume of the product in the container 10 decreases which in turn results in a decreased pressure, or vacuum, within the container 10. While designed for use in hot-fill applications, it is noted that the container 10 is also acceptable for use in non-hot-fill applications.

Since the container 10 is designed for "hot-fill" applications, the container 10 is manufactured out of a plastic material, such as polyethylene terephthalate ("PET"), and is heat set such that the container 10 is able to withstand the entire hot-fill procedure without undergoing uncontrolled or unconstrained distortions. Such distortions may result from either or both of the temperature and pressure during the initial hot-filling operation or the subsequent partial evacuation of the container's interior as a result of cooling of the product. During the hot-fill process, the product may be, for example, heated to a temperature of about 180 degrees Fahrenheit or above and dispensed into the already formed container 10 at these elevated temperatures.

Figure 2:
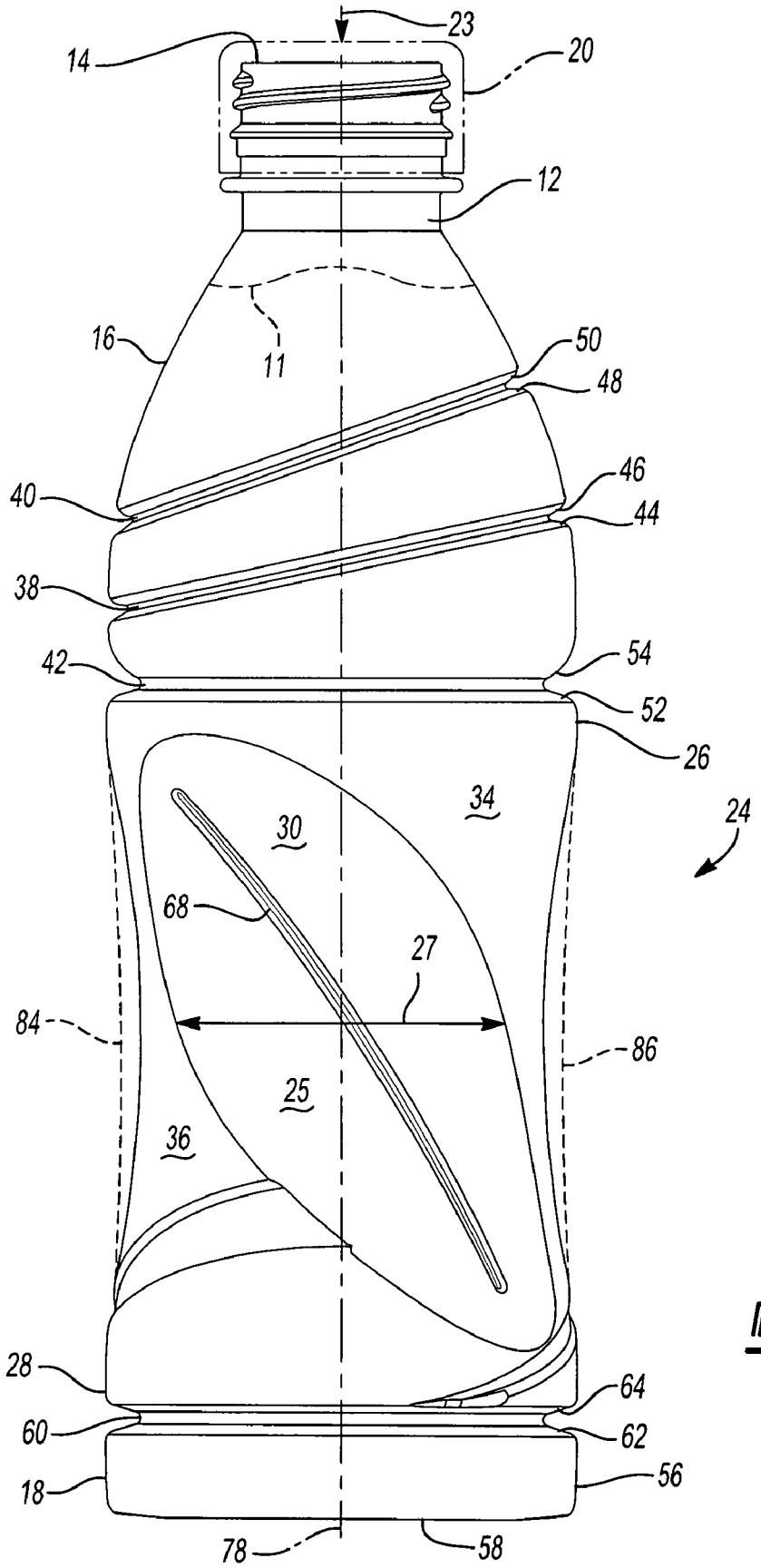
FIG. 2 is a side view of the container depicting a sidewall vacuum panel and expansion positions of the columns.
Figure 3:
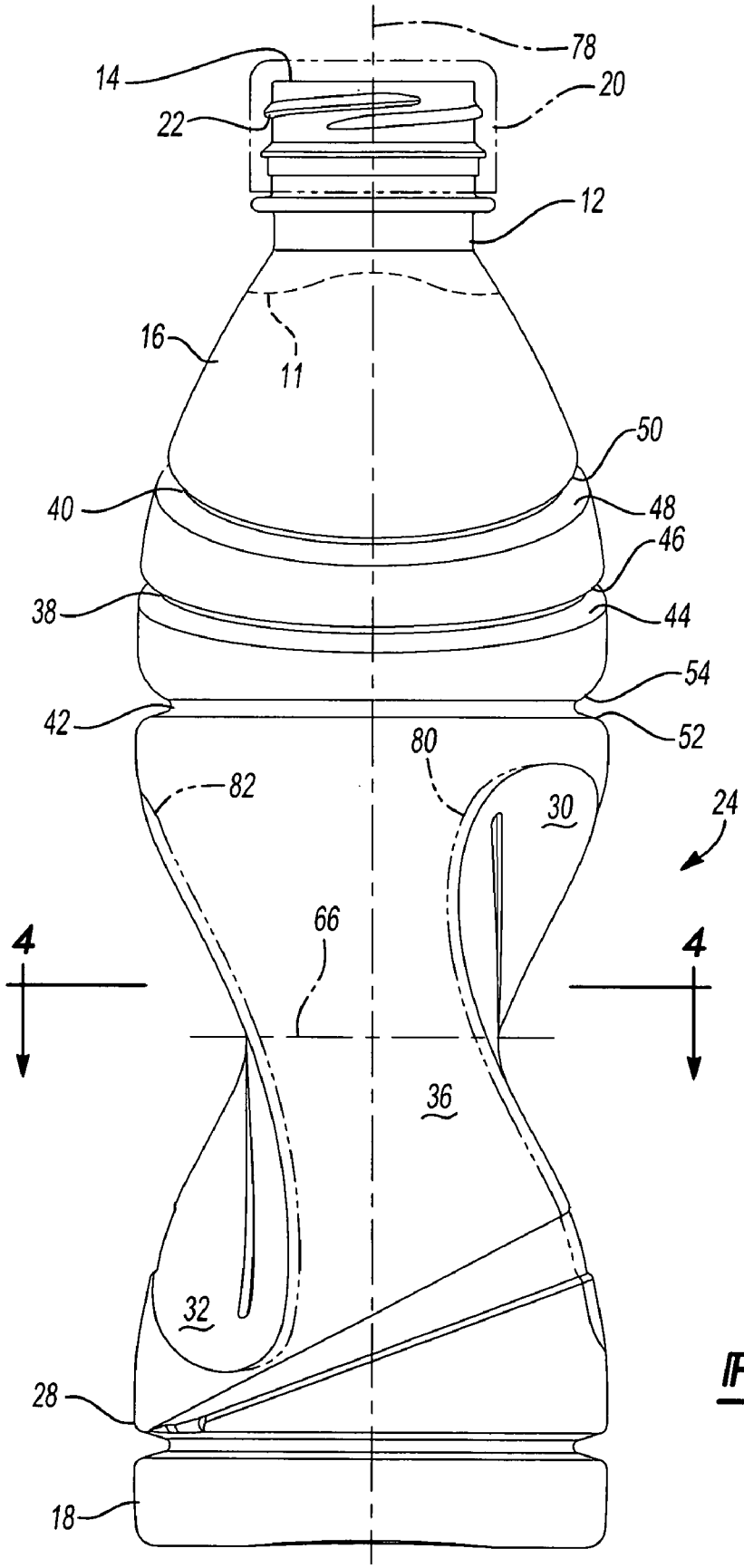
FIG. 3 is a side view of the container depicting a sidewall column and contraction positions of the vacuum panels.

As depicted in FIGS. 1-3, the container 10 generally includes an upper portion 12, which defines a mouth 14, a shoulder portion 16 and a bottom portion 18. As depicted, the shoulder portion 16 and the bottom portion 18 are substantially annular or circular in cross-section. A cap 20 engages threads 22 on the upper portion 12 to close and seal the mouth 14.

Extending between the shoulder portion 16 and the bottom portion 18 is a sidewall or body 24 of the container 10. As depicted in FIGS. 1-4, the body 24 has a variety of cross-sectional shapes. Near the transition between the shoulder portion 16 and the sidewall 24, the cross-sectional shape is circular; however, within and throughout the sidewall 24 between the shoulder portion 16 and bottom portion 18, the cross-sectional shape varies. At a top portion 26 of the sidewall 24 and a lower portion 28 of the sidewall 24, the cross-sectional area is circular. However, between the shoulder portion 16 and the bottom portion 18, the cross-sectional area varies due to employment of a recessed first vacuum panel 30 and a recessed second vacuum panel 32, which together make up a pair of opposing vacuum panels 30, 32. Similarly, the sidewall 24 employs a first column 34 and a second column 36 which make up a pair of opposing columns 34, 36 which are located between the vacuum panels 30, 32. Because the vacuum panels 30, 32 and columns 34, 36 are opposing their respective selves, that is vacuum panel 30 faces vacuum panel 32 and column 34 faces column 34 across the container volume, they alternate or are staggered around the periphery or circumference of the sidewall 24 of the container 10 in the fashion of; first vacuum panel 30, first column 34, second vacuum panel 32, second column 36.

Before continuing with a description of the container sidewall 24, a brief description of the shoulder portion 16 and bottom portion 18 will be provided. The container shoulder portion 16 is generally of a conical shape with a narrower cross section that joins or forms into the upper portion 12 while the opposite end of the shoulder portion 16 has a larger cross section and meets with the sidewall 24. The shoulder portion 16 may be equipped with one or more recessed ribs or grooves that are circular or elliptical, such as groove 38 and groove 40. Between the shoulder portion 16 and the sidewall 24, a transition groove 42 may exist. The grooves 38, 40, 42 may have groove walls. For instance, groove 38 may have groove walls 44, 46, groove 40 may have groove walls 48, 50, and groove 42 may have groove walls 52, 54. As depicted in FIGS. 1-3, grooves 38, 40 may be elliptical, or non-horizontal and non-parallel to the bottom portion 18, while groove 42 may be circular, horizontal and parallel to the bottom portion 18 or surface upon which the container may rest. The bottom portion 18 of the container may have a chime 56 located between a contact ring 58, which contacts a surface upon which the container rests, and a bottom groove 60. Like the other grooves in the container 10, the bottom groove 60 has groove walls 62, 64.

There are advantages to the grooves 38, 40, 42 and 60. For instance, because the grooves are formed by their respective groove walls, as noted above, which project toward a container interior volume, additional strength is added to the container sidewall 24 because the material's moment of inertia is increased at the location of the grooves 38, 40, 42 and 60. The grooves 38, 40, 42 and 60 are also known as strengthening ribs 38, 40, 42 and 60. There is another advantage to the grooves 38, 40, 42 and 60, and in particular, groove 42 and groove 60. The horizontally arranged grooves 42, 60 are able to receive and absorb a vertically-applied, compressive load 23, such as may be imparted on the container cap 20 when the container 10 is part of a case or pallet of containers, which may then become top-loaded with another case or pallet of containers. Because the container 10 contains the horizontal grooves 42 and 60, the container 10 will not buckle under a shock load of a case or pallet of containers, when applied within container buckling limits. Although grooves 38, 40 are not horizontally arranged, they are still capable of absorbing vertical loading, especially in instances such as when one case or pallet of containers is released onto another case or pallet of containers, as in the case of an initial shock load. In such a scenario, buckling may be prevented. Additionally, the grooves 38, 40 act as strengthening ribs and provided circumferential strength to the shoulder portion 16 of the container 10.

A description of the container sidewall 24 will now be presented. FIGS. 1-3 depict a container sidewall 24 that employs opposing vacuum panels 30, 32, which are generally oval in shape and extend vertically between the shoulder portion 16 and the bottom portion 18 of the container 10. In the present teachings, the vacuum panels 30, 32 are identical, thus when only one is described, one will appreciate that the other is identical in function and structure. The first and second vacuum panels 30, 32 are located opposite one another such that they are generally facing each another. Thus, the "first" and "second" designations may also be thought of as "front" and "rear," respectively; however, such designations are merely used for differentiation purposes and not to designate actual front and rear portions of the container 10. Furthermore, while the vacuum panels 30, 32 generally face each other, they are not a "reflected image" or "mirror image" of each other. More specifically, the vacuum panels 30, 32 are arranged or angled in the same direction, thus forming an "X" when viewed through the container 10. The significance of such an arrangement is that an even vacuum "squeeze" is experienced by the sidewall 24.

Figure 4:
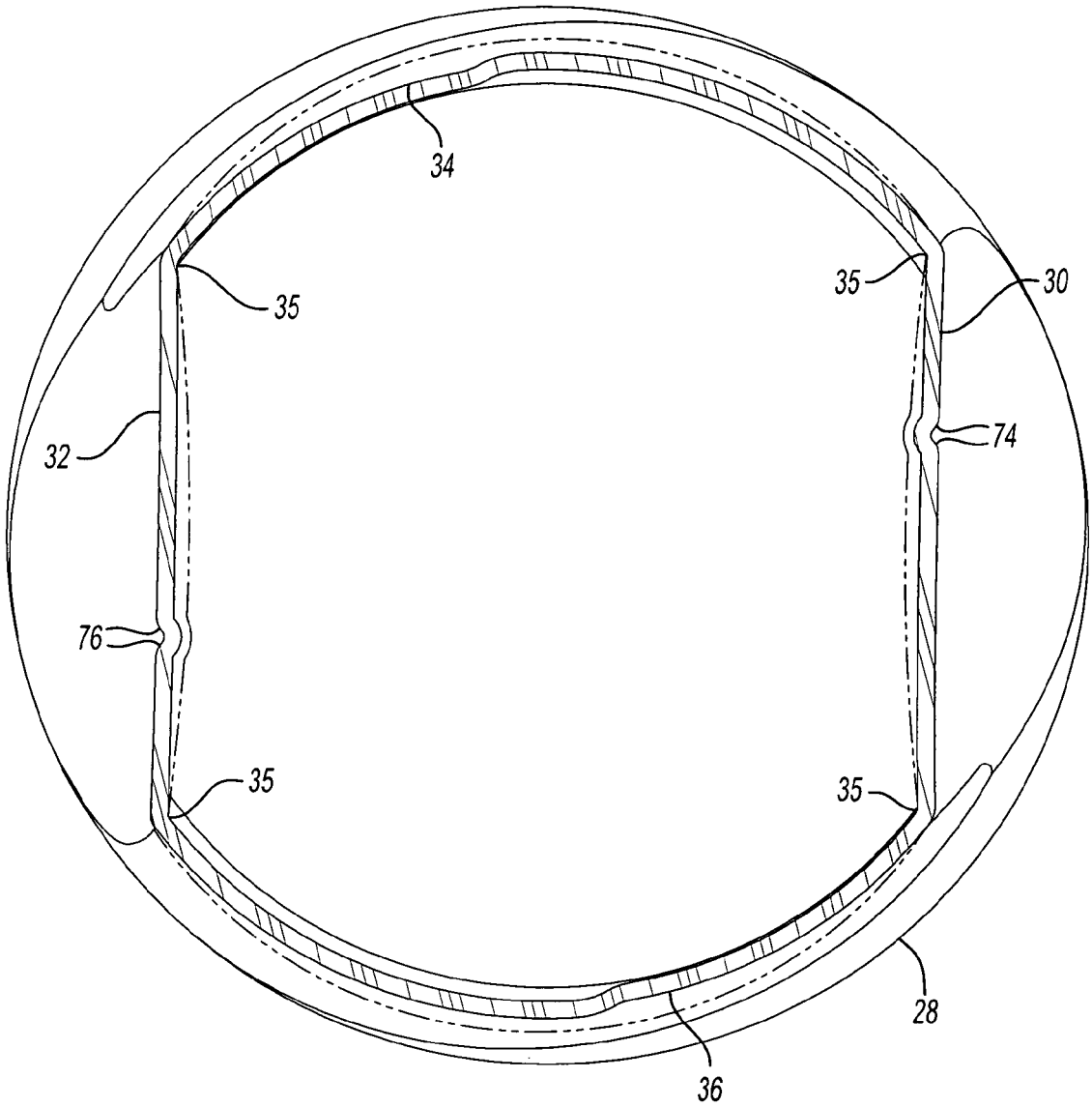
FIG. 4 is a cross-sectional view of the container depicting contraction positions of the vacuum panels and expansion position of the columns.

The first and second vacuum panels 30, 32 exhibit a generally inward, arcuate shape from top to bottom between the shoulder portion 16 and the bottom portion 18, as depicted in FIGS. 1 and 3. This arcuate shape may also be described as concave inward and as defining a generally oval shape. Furthermore, the oval shape may also be considered helix or helical shaped, since the vacuum panels 30, 32 are "twisted" and formed with compound angles. The vacuum panels 30, 32 are slanted or tilted such that their longitudinal centerline or longitudinal axis forms an angle that is not ninety degrees with the contact ring 58 of the bottom portion 18. The contact ring 58 is that portion of the container 10 that contacts a surface upon which the container 10 rests. FIG. 3 exemplifies that the sidewall 24 of the container 10 also has an approximate horizontal midpoint axis 66 at which vacuum panel 30 and vacuum panel 32 define a minimum distance across the volume of the container 10. FIG. 4 depicts the minimum distance between the parallel vacuum panels 30, 32 when not subjected to a vacuum pressure.

As depicted in FIGS. 1 and 3, the vacuum panels 30, 32 are also arcuately shaped in a transverse direction, or a direction parallel to a surface upon which the container 10 would rest, such that the arcuate shape is generally inwardly directed or concave. Because the vacuum panels 30, 32 are structured to employ such compound angles, a person handling the container 10 can grasp the container 10 with, for example, his or her right hand and the right palm will settle into or conform to the sidewall 24, such as at location 25 of the vacuum panel 30. Furthermore, the vacuum panels 30, 32 are diagonally arranged on the body or sidewall 24 of the container 10, and thus, are able to traverse or cover a larger area of the container sidewall 24. The advantage to such an arrangement is that the vacuum panels 30, 32 may be made larger than if they were arranged vertically. Additionally, because the vacuum panels 30, 32 are diagonal and angled across the body or sidewall 24 with respect to a horizontal surface, and larger than strictly vertical vacuum panels, fewer of them on a container may be necessary. Moreover, angled vacuum panels 30, 32 may have a wider or longer distance 27 across a width of a single vacuum panel 30, as depicted in FIG. 2, which results in a vacuum panel 30 that is more responsive to an internal vacuum pressure within the container 10 as opposed to a panel that is not as wide, and thus stronger and more resistant to a vacuum pressure. Still yet, larger concave inward vacuum panels 30, 32 may provide an area large enough to accommodate a human palm to facilitate container holding.

The first vacuum panel 30 is equipped with a first vacuum panel hinge or groove 68, also known as a first vacuum panel initiator 68 or simply as a first initiator 68. Similarly, the second vacuum panel 32 is equipped with a second vacuum panel hinge or groove 70, also known as a second vacuum panel initiator 70 or second initiator 70. The first and second initiators 68, 70 are called such because upon a liquid 11 beginning to cool within the container 10, the volume of the container 10 will begin to be increasingly displaced due to the contraction of the container 10 along the first and second initiators 68, 70. Thus, the first and second initiators 68, 70 are the locations within the first and second vacuum panels 30, 32 of the sidewall 24 where the vacuum within the container 10 begins to alter the position of the vacuum panels 30, 32 just before the balance of the vacuum panels 30, 32 begins to move. More specifically, the walls 74 of the first initiator 68 and the walls 76 of the second initiator 70 will begin to be drawn toward the interior of the container 10, such as toward the container central vertical axis 78, as depicted with phantom lines 80, 82. Upon initial movement of the first and second initiators 68, 70, the balance of the vacuum panels 30, 32, beginning with the portions closest to the initiators 68, 70, will then begin to move toward the central vertical axis 78, that is, toward an interior of the volume of the container 10.

Separating the first vacuum panel 30 from the second vacuum panel 32 is the pair of diametrically opposed columns 34, 36 and it is the placement and shape of the columns 34, 36 relative to the vacuum panels 30, 32 which, in one instance, permits the vacuum panels 30, 32 to move toward the central vertical axis 78 and to cause the columns 34, 36 to move away from the central vertical axis 78. Located on opposing sides of the container 10, the columns 34, 36 are depicted in FIGS. 1-4 to be located at each end of the vacuum panels 30, 32. Furthermore, the columns 34, 36 are outwardly arcuate or semicircular and resist deformation inward toward the central vertical axis 78 when the volume of the container 10 is subjected to a vacuum from a cooling liquid 11. Moreover, the arcuate columns 34, 36 are also shaped to accommodate part of the palm of a person who holds the container 10.

As depicted best in FIG. 2, the lengths of the columns 34, 36 extend from the shoulder portion 16 to the bottom portion 18 with the width of the columns 34, 36 varying over their length. As depicted in FIG. 3, the column 36 (from the shoulder portion 16 to the bottom portion 18) decreases in width to about its longitudinal midpoint and thereafter increases in width. This width variation may be generally symmetrical about a horizontal midpoint axis 66 of the column portions 34, 36 and present an hourglass silhouette of the column portions 34, 36. In alternative embodiments, the widths of the column portions 34, 36 need not vary so much over their lengths, as described above, but instead the widths of the columns 34, 36 may remain more constant along the length of the columns from the shoulder portion 16 to the bottom portion 18.

As depicted best in FIG. 2, the column portions 34, 36 exhibit a shape which is generally inwardly curved or concave when the container 10 is initially formed and before it is filled with a hot liquid. Upon hot-filling, capping and permitting the container 10 to cool, the radius of curvature in the columns 34, 36 will decrease. That is, the columns 34, 36 will more closely approach a vertical position to account for the contracting vacuum panels 30, 32, which move toward the central vertical axis 78 during cooling. Because the columns more closely approach a vertical position, the ability of the container 10 to support a vertical load improves, thus when cases or pallets of the containers 10 are hot-filled and capped, they may better support stacking arrangements.

The transition between the columns 34, 36 and the vacuum panels 30, 32 is a step downward of sorts, or rather a decrease in the radial distance to the central vertical axis 78, as is evident in FIG. 4 at locations 35. This transition defines a step downward from the columns 34, 36 to the vacuum panels 30, 32 because the columns 34, 36 are located at a greater radial distance from the central vertical axis 78 of the container 10 than the vacuum panels 30, 32.

The container 10 as previously described generally addresses the container 10 as it is originally formed. The discussion will now focus on changes in the structure after hot-filling the container 10. After a hot liquid product 11 is filled into the container 10, the container 10 is immediately capped and begins cooling, and thus the product within the container 10 begins decreasing in volume. This reduction in product volume produces a reduction in pressure within the container 10 and begins to exert forces on the interior wall(s) of the container 10. The vacuum panels 30, 32 of the container 10 controllably accommodate this pressure reduction by being pulled or contracted inward toward the central vertical axis 78, as depicted using phantom lines 80, 82 in FIG. 3. The overall external surface area of the container 10 that the two vacuum panels 30, 32 occupy facilitates the ability of the vacuum panels 30, 32 to accommodate a significant amount of the reduced pressure or vacuum. Moreover, the inwardly recessed curved surface of the vacuum panels 30, 32, formed by compound angles, are configured such that they absorb or account for at least 50% of the reduced pressure or vacuum, and preferably at least 65%, and most preferably about 85%, upon cooling of the liquid.

As the vacuum panels 30, 32 move or contract inwardly toward the central vertical axis 78, the generally circular shape of the body or sidewall 24 permits or causes the columns 34, 36 to deflect radially outward from their non-filled position and into a more upright orientation. This phenomenon is depicted with phantom lines 84, 86 in FIG. 2. Additionally, a decorative embossed motif or word, such as a company name or drink name, may be molded into the columns 34, 36 to enhance vertical strength.

Because of the significant reduction in vacuum pressure of the container 10 after cooling, the container 10 has a greater propensity to not retain outwardly induced, but inwardly directed, dents which normally occur during handling or shipping. Containers with higher resultant vacuum pressures (and therefore less vacuum accommodation) tend to retain or hold such dents as a result of the vacuum forces themselves. The novel shape of the container 10 further lends the container 10 to light weighting as the vacuum panels 30, 32, given their orientation, require less material than if a circular sidewall were used in their place.

What is claimed is:

1. A container structure comprising:

an upper portion defining a mouth;

a shoulder portion formed with the upper portion and extending downward from the upper portion;

a bottom portion forming a base;

a sidewall extending between and joining the shoulder portion and the bottom portion;

a pair of opposing vacuum panels as part of the sidewall, each vacuum panel having a central region that defines a vacuum panel longitudinal axis;

a pair of opposing columns arranged between the pair of opposing vacuum panels thereby forming a circumference of the container; and a vacuum initiator built into each vacuum panel of the pair of opposing vacuum panels, each vacuum initiator recessed radially inward from its respective vacuum panel, each vacuum initiator having a first end, a second end that is spaced apart from the first end, and an initiator longitudinal axis, each vacuum initiator extending from the respective first end to the respective second end along the central region of the respective vacuum panel to be substantially coincident with the respective vacuum panel longitudinal axis, wherein the pair of opposing columns are at a first position relative to a central vertical axis when the container is not filled, and move away from the central vertical axis when the container experiences an internal vacuum.

2. The container of claim 1, further comprising:

a circumferential base groove defining base groove walls, the base groove formed into the base of the container.

3. The container of claim 2, wherein the base groove is horizontal and a depth of the base groove permits vertical movement of the base groove walls.

4. The container of claim 1, further comprising:

a circumferential shoulder groove defining shoulder groove walls, the shoulder groove formed into the shoulder portion of the container.

5. The container of claim 4, wherein the shoulder groove is horizontal and a depth of the shoulder groove permits vertical movement of the shoulder groove walls.

6. The container of claim 1, wherein each of the vacuum panels is angled about its respective vacuum panel longitudinal axis relative to the base.

7. The container of claim 1, wherein each of the vacuum initiators is angled about its respective initiator longitudinal axis relative to the base.

8. The container of claim 1, wherein each of the opposing columns has a column longitudinal axis, and wherein each of the opposing columns is angled about its respective column longitudinal axis relative to the base.

9. A container structure defining a central vertical axis, the container structure comprising:

an upper portion defining a mouth;

a shoulder portion formed with the upper portion and extending downward from the upper portion;

a bottom portion forming a base;

a sidewall extending between and joining the shoulder portion and the bottom portion;

a pair of opposing columns as part of the sidewall, the columns oriented diagonally relative to the base;

a pair of opposing vacuum panels as part of the sidewall, the vacuum panels each having a central region that defines a vacuum panel longitudinal axis that is oriented diagonally relative to the base; and a pair of vacuum initiators each built into one of the pair of opposing vacuum panels, wherein the vacuum initiators each are recessed inwardly from its respective vacuum panel, each vacuum initiator having a first end, a second end that is spaced apart from the first end, and an initiator longitudinal axis, each vacuum initiator extending from the respective first end to the respective second end along the central region of the respective vacuum panel to be substantially coincident with the respective vacuum panel longitudinal axis, wherein the pair of opposing columns are at a first position relative to the central vertical axis when the container is not filled, and move away from the central vertical axis when the container experiences an internal vacuum.

10. The container structure of claim 9, wherein the vacuum initiator further comprises:

a vacuum initiator groove defining vacuum initiator groove walls, wherein upon contraction of a container liquid content, the groove walls initiate movement in the container structure.

11. The container structure of claim 9, wherein the pair of opposing vacuum panels are contoured to conform to a palm of a human hand.

12. The container structure of claim 9, wherein walls of the vacuum panels are parallel to each other at approximately a horizontal centerline of the vacuum panel.

13. The container structure of claim 9, wherein the pair of opposing vacuum panels are formed with compound angles.

14. The container structure of claim 9, further comprising:

a circumferential base groove defining base groove walls, the base groove formed into the base of the container.

15. The container structure of claim 14, wherein the base groove is horizontal and a depth of the base groove permits vertical movement of the base groove walls.

16. The container structure of claim 9, further comprising:

a circumferential shoulder groove defining shoulder groove walls, the shoulder groove formed into the shoulder portion of the container.

17. The container structure of claim 16, wherein the shoulder groove is horizontal and a depth of the shoulder groove permits vertical movement of the shoulder groove walls.

18. A container structure defining a central vertical and horizontal axis, the container structure comprising:

an upper portion defining a mouth;

a shoulder portion formed with the upper portion and extending downward from the upper portion;

a bottom portion forming a base;

a sidewall extending between and joining the shoulder portion and the bottom portion;

a pair of opposing columns as part of the sidewall, the columns oriented diagonally relative to the base and concave inward relative to the central vertical axis when the container is not filled with a liquid, and move away from the central vertical axis and are concave inward to a lesser extent when the container is under an interior vacuum;

a pair of opposing vacuum panels as part of the sidewall, the vacuum panels each having a central region and a vacuum panel longitudinal axis that is oriented diagonally relative to the base; and a vacuum initiator groove formed as part of each of the pair of opposing vacuum panels, each of the vacuum initiator grooves recessed radially inward from its respective vacuum panel, each vacuum initiator groove having a first end, a second end that is spaced apart from the first end, and an initiator longitudinal axis, each vacuum initiator extending from the respective first end to the respective second end along the central region of the respective vacuum panel to be substantially coincident with its respective vacuum panel longitudinal axis.

19. The container structure of claim 18, wherein the vacuum initiator groove further comprises:

vacuum initiator groove walls, wherein upon contraction of liquid content within the container, the groove walls initiate movement toward the central vertical axis.

20. The container structure of claim 19, wherein the pair of opposing vacuum panels are formed with compound angles.

21. The container structure of claim 20, wherein walls of the vacuum panels are parallel to each other at approximately a horizontal centerline of the container structure.

22. The container structure of claim 21, wherein the pair of opposing vacuum panels are contoured to conform to a palm of a human hand.

* * * * *